United States Patent [19]

Deibele et al.

[11] 4,389,551

[45] Jun. 21, 1983

[54] PROBE-ACTUATED GUARD SHIELD SWITCH

[75] Inventors: Florian C. Deibele, Portland; William F. Schell, Banks, both of Oreg.

[73] Assignee: Tektronix, Inc., Beaverton, Oreg.

[21] Appl. No.: 282,761

[22] Filed: Jul. 13, 1981

[51] Int. Cl.[3] ..... H01H 9/22

[52] U.S. Cl. ..... 200/51 R; 200/50 B; 200/51.09; 200/153 LA

[58] Field of Search ..... 200/153 LA, 51 R, 51.09, 200/51.1, 50 B; 339/40

[56] References Cited

U.S. PATENT DOCUMENTS

| | | | |
|---|---|---|---|
| 2,540,496 | 2/1951 | Sperrazza | 200/51.09 |
| 3,222,631 | 12/1965 | Cohen | 339/40 |
| 3,801,757 | 4/1974 | Carissimi et al. | 200/51.09 |
| 4,145,590 | 3/1979 | Repplinger | 200/153 LA |
| 4,271,337 | 6/1981 | Barkas | 339/40 |

FOREIGN PATENT DOCUMENTS

| | | | |
|---|---|---|---|
| 634753 | 3/1950 | United Kingdom | 200/51.09 |

*Primary Examiner*—John W. Shepperd
*Attorney, Agent, or Firm*—George T. Noe

[57] ABSTRACT

A probe-actuated guard-shield switch mechanism automatically disconnects a guard shield to an input terminal of a measurement instrument upon insertion of a guard probe, and reconnects the guard shield upon removal of the guard probe. The mechanism provides a break-before-make connection sequence for safety reasons, and also provides a non-conductive safety gate to minimize shock hazard.

4 Claims, 3 Drawing Figures

PROBE-ACTUATED GUARD SHIELD SWITCH

BACKGROUND OF THE INVENTION

The present invention relates generally to safety switch mechanisms, and in particular to a switch which is actuated by the insertion and removal of a probe.

Certain electronic test and measurement instruments, such as digital multimeters, are designed to facilitate a variety of measurement capabilities, including so-called floating measurements, e.g., measurements made with references to some potential other than earth ground. To this end, four input terminals are typically provided—high, low, guard, and chassis ground—which are electrically separated by predetermined impedances internal to the instrument. The actual measurement is made between the high and low inputs. A disconnectable bus bar is usually provided between the low and chassis ground terminals for DC-to-ground measurements and is disconnected for floating measurements. The guard terminal is electrically connected to a guard shield which is located physically adjacent the internal circuits to thereby establish a largely capacitive impedance between the low and guard inputs. Guarding is a passive technique to reduce common-mode noise between the high and low input terminals and chassis ground by shunting such noise-to-ground phenomena away from the input terminals. By rejecting common-mode noise in this fashion, higher-accuracy measurements may be made. The guard terminal may therefore be connected to an external guard voltage source, which may include a reference voltage within the circuit being measured and may even be the low input at the measurement source, to externally drive the guard shield.

Often it is desirable to connect the low input to the guard input within the instrument to short out the impedance therebetween and thus elevate the guard shield to the potential applied to the low terminal, particularly when no external guard voltage is applied. This may be achieved by the simple expedient of placing a switch between the low input and the guard input; however, other problems arise in that a shock hazard may be created at the unused guard terminal and that an externally-applied guard voltage may be shorted to a different potential applied via the switch to the guard shield.

SUMMARY OF THE INVENTION

In accordance with the present invention, a probe-actuated guard-shield switch is provided between the low and guard inputs of a digital multimeter to automatically connect the guard shield to the low input when a guard probe is removed. The switch and the guard receptacle are disposed in a non-conductive housing. A spring-biased actuating plunger which engages a button on the switch is disposed along an axis which is transverse to the axis of the receptacle, and when fully extended provides a non-conductive gate across at least a portion of the receptacle to eliminate any shock hazard. When the guard probe is inserted into the guard terminal, the actuating plunger is moved against spring pressure away from the receptacle axis, and in so doing, actuates the switch and disconnects the low input from the guard shield before the probe contacts the receptacle. Thus, a break-before-make sequence is effectuated to eliminate any shock hazard, since the low terminal is never connected to the guard probe. When the probe is removed, the plunger is biased by the spring to its original position.

It is therefore one object of the present invention to provide in an electronic measurement instrument a guard-shield switch which automatically connects a guard shield to a low input terminal when no guard probe is connected.

It is another object of the present invention to eliminate a safety hazard in a multiple-input electronic instrument in which two more inputs are internally electrically connectable, by providing a break-before-make switch mechanism which is actuated by the insertion or removal of an input probe to disconnect such inputs from each other before an external voltage is applied.

It is another object of the present invention to eliminate the shock hazard associated with an exposed voltage terminal by covering it at least partially with a non-conductive member when not in use.

Other objects and advantages of the present invention will become obvious to those having ordinary skill in the art upon a reading of the following description when taken in conjunction with the accompanying drawings.

DRAWINGS

DETAILED DESCRIPTION OF THE INVENTION

Figure 1:
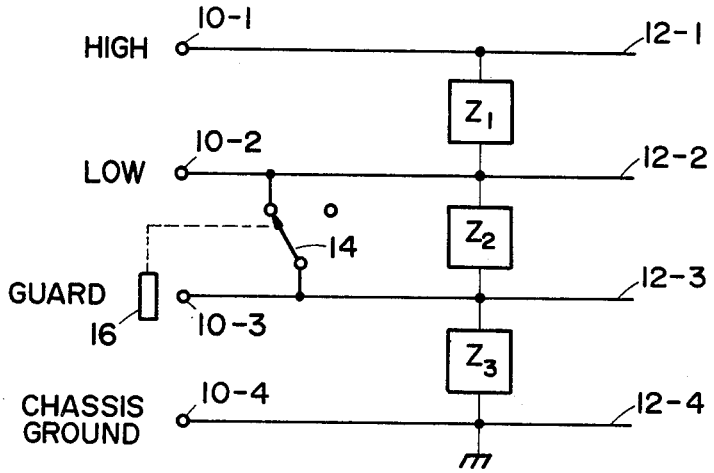
FIG. 1 is a schematic representation of the input terminal portion of a digital multimeter to aid in understanding the present invention.

Referring to FIG. 1, there is shown a schematic representation of the input portion of a digital multimeter which embodies the present invention. There are four input terminals 10-1, 10-2, 10-3, and 10-4, labeled HIGH, LOW, GUARD, and CHASSIS GROUND, respectively, connected to respective lines 12-1, 12-2, 12-3, and 12-4. An impedance $Z_1$, shown connected between lines 12-1 and 12-2, represents the impedance of the multimeter circuits. An impedance $Z_2$, shown connected between lines 12-2 and 12-3, represents the circuit-to-guard-shield impedance. A third impedance $Z_3$, shown connected between lines 12-3 and 12-4, represents the guard-shield-to-ground impedance. A guard-shield switch 14 is connected between lines 12-2 and 12-3 to selectively short out the $Z_2$ impedance and thereby connect the potential applied to LOW input 10-2 to the guard shield, which may be represented by line 12-3. An actuating mechanism 16 is disposed adjacent the GUARD input terminal 10-3, and will be described completely in connection with FIGS. 2 and 3. When the GUARD input terminal 10-3 is not used, the switch 14 is as shown in the left-hand position, with the lines 12-2 and 12-3 connected together. When an input probe is connected to the GUARD input terminal 10-3, the switch 14 is thrown to the right-hand position, effectively switching the impedance $Z_2$ into the circuit between lines 12-2 and 12-3.

Figure 2:
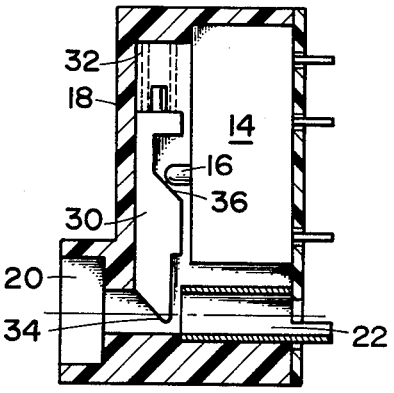
FIG. 2 is a section view of a probe-actuated guard-shield switch in accordance with present invention, with the probe removed.
Figure 3:
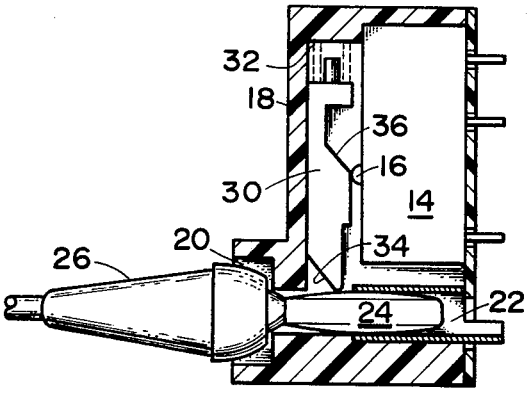
FIG. 3 is a section view of a probe-actuated guard-shield switch in accordance with the present invention, showing the probe inserted.

FIGS. 2 and 3 show the details of the guard-shield switch in both operative positions. The switch 14, which may suitably be a conventional microswitch having a spring-loaded actuating button 16 is disposed in a housing 18 which is constructed of a non-conductive material such as plastic. A probe insert opening 20 is provided through a built-up portion of the housing wall, and axially aligned therewith is a tubular conductive metal receptacle 22 for receiving a probe tip 24 of a test probe 26 in wiping engagement therewith. The probe tip 24, shown inserted in FIG. 3, may suitably be a banana plug. Other types of tips may be also utilized, as long as the receptacle 22 mates with the chosen type. A spring-biased elongate actuating plunger 30, formed of non-conductive material such as plastic, is disposed within the housing 18 along an axis which is transverse to the central axis of the receptacle 22. A coil spring 32, shown by dashed lines, is situated between the distal end of the plunger 30 and the top of the housing 18 to bias the plunger downward. The plunger 30 has a pair of opposed ramped bearing surfaces 34 and 36 to translate the horizontal displacement of the probe tip 24 into vertical displacement of the plunger 30, and accordingly, horizontal displacement of the actuating button 16 of switch 14. The slopes of the bearing surfaces 34 and 36, while shown at approximate 45-degree angles with respect to the plunger axis, may be oriented at any angle which effectuates the desired displacements, and accordingly, the two surfaces may be at different angles. The housing 18 may be secured to a digital multimeter using any of a number of conventional methods, and the pins of switch 14 and receptacle 22 may be electrically connected to corresponding circuits in any conventional manner.

It is important to note in FIG. 2 that receptacle 22 is recessed a substantial distance from the opening 20, and that the proximate, or lower end of the fully extended non-conductive plunger 30 forms a gate which extends across at least a portion of the conductive receptacle 22 to thereby minimize shock hazard.

When the guard-voltage input probe 26 is inserted into opening 20, the tip 24 engages the bearing surface 34, causing the plunger 30 to ride up against the pressure of spring 32 as it compresses, pushing the actuating button 16 in, disconnecting switch 14 (throwing it to the right-hand position in FIG. 1), before the probe tip 24 makes electrical contact with the receptacle 22. Thus, a break-before-make sequence is effectuated to disconnect the low input terminal 10-2 from the guard shield 12-3 before a guard voltage is applied to terminal 10-3, thereby obviating a safety hazard. In fact, the mechanism of the present invention presents the low terminal from ever being connected to the guard probe. When the probe tip 24 is removed, it must clear the end of receptacle 22 before plunger 30 slides downward under spring pressure, allowing the switch actuating button 16 to move out of the switch body under its own spring pressure. When the guard probe is removed, the switch 14 automatically reconnects the low terminal to the guard shield.

While we have shown and described a preferred embodiment of our invention, it will become obvious to those having ordinary skill in the art that many changes and modifications may be made without departing from our invention in its broader aspects. Accordingly, it is contemplated that the appended claims will be interpreted to cover any such modifications or embodiments as fall within the true scope of the invention.

What we claim as our invention is:

1. A guard voltage input device having a probe-actuated switch which automatically disconnects a guard shield from a signal input line upon insertion of a probe tip into said device and automatically reconnecting said guard shield to said signal input line upon removal of said probe tip, comprising:

a non-conductive housing having a probe tip insertion opening therein;

a receptacle axially aligned with said opening for receiving said probe tip, said receptacle electrically connectable to said guard shield;

a switch disposed in said housing, said switch having a first terminal electrically connectable to said signal input line and a second terminal electrically connectable to said guard shield; and a spring-biased actuating member disposed at a substantially right angle to the central axis of said receptacle, said member being engaged by said probe tip as it is inserted and being displaced thereby, opening said switch.

2. A device in accordance with claim 1 wherein said receptacle is recessed in said housing, and said actuating member has a portion thereof disposed between said opening and said receptacle so that upon insertion of said probe tip said switch is opened before said probe tip contacts said receptacle.

3. A device in accordance with claim 1 wherein said actuating member is an elongate plunger having a proximate end which extends across at least a portion of said receptacle to provide a protective gate in the extended position of said plunger.

4. A device in accordance with claim 3 wherein said plunger is provided with a pair of bearing surfaces oriented at an angle with respect to the central axis of said receptacle, one of said pair of bearing surfaces being provided at the proximate end of said plunger for engagement with said probe tip and the other of said pair of bearing surfaces being disposed adjacent said switch for actuation thereof.

* * * * *